United States Patent [19]

Marsh

[11] 3,982,450

[45] Sept. 28, 1976

[54] PLASTIC FORCEPS HINGE

[75] Inventor: William Francis Marsh, Walmer, England

[73] Assignee: Haffenden-Richborough Limited, England

[22] Filed: Apr. 28, 1975

[21] Appl. No.: 571,944

[30] Foreign Application Priority Data

May 20, 1974 United Kingdom ..... 22378/74

[52] U.S. Cl. ..... 81/416; 30/266; 403/349

[51] Int. Cl.[2] ..... B25B 7/06

[58] Field of Search .....81/416, 415; 30/266; 128/321, 318; 403/349, 348, 353

[56] References Cited

UNITED STATES PATENTS

| | | | |
|---|---|---|---|
| 392,032 | 10/1888 | Jacobson | 403/348 |
| 2,240,946 | 5/1941 | Vido | 81/416 |

*Primary Examiner*—James L. Jones, Jr.

*Attorney, Agent, or Firm*—Scrivener Parker Scrivener and Clarke

[57] ABSTRACT

A pair of forceps comprises two identical members of unitary plastics construction each including a jaw, a handle, and a projection which cooperates with an arcuate slot in the other member to pivotally connect the members in their normal working positions, but permit lateral separation of the members when they are in another relative angular position.

4 Claims, 4 Drawing Figures

PLASTIC FORCEPS HINGE

This invention relates to hand tools (such as pincers) and surgical instruments (such as surgical forceps) of the type comprising two elongated parts pivotally secured together at a medial location and having a pair of working jaws manually operated by handles located on the side of the pivot opposite to the jaws.

It is known in the art to construct a pair of forceps from two independent separable parts which may be located together in one relative angular position of the parts and interlocked by rotating them into a second, normal working position. The pivot serves both to rotatably connect the parts and to prevent their separation.

In one such known construction, one forcep part or member has a shaped projection which cooperates with a correspondingly shaped slot in the other forcep member to provide the releasable pivotal connection. This has the disadvantage that the two members are dissimilar, and two sets of tools are required for their production. Also, the members must be paired for assembly, and if some parts are broken or rejected, corresponding mating parts are wasted.

The present invention aims at eliminating these disadvantages by providing a tool or instrument member which will releasably interlock with a second member of the same form to produce a complete tool or instrument of the type initially described.

In accordance with the invention there is provided a member for a hand tool having a pair of pivotally connected jaws manually operable by handles located on the side of the fulcrum remote from the jaws, the member being elongated and of unitary construction, and comprising a jaw, a handle, and pivot means intermediate the jaw and handle including a projection and a recess which are so arranged and configured that the member can be removably positioned laterally together with a second member of the same form in one relative angular position of the members, the projection of each member being received in the slot of the other member, and can be rotated relative to the second member, from the said one position to a second, normal working position in which the members are pivotally movable, but retained against lateral separation by cooperation between each projection and the recess in which it is received.

In a preferred embodiment the recess is a circulary arcuate slot having an enlarged portion at one arcuate end thereof, and the projection extends outwardly from the interruption formed between the ends of the slot and has an enlarged head, whereby the member can be interlocked with the second member by placing the members together in the said one angular position in which the projection of each member aligns with the enlarged slot portion of the other member, and relatively rotating the members to the second angular position in which the enlarged heads of the projections prevent separation of the two members.

The member may conveniently be manufactured from plastics material by injection moulding.

A forcep member embodying the invention is described below by way of example with reference to the accompanying drawings, in which.

Figure 1:
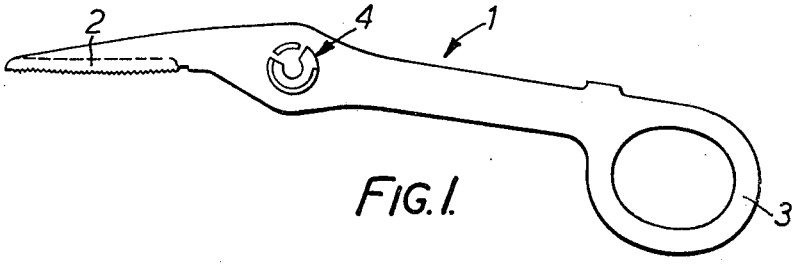
FIG. 1 is an underneath plan view of the forcep member.
Figure 2:
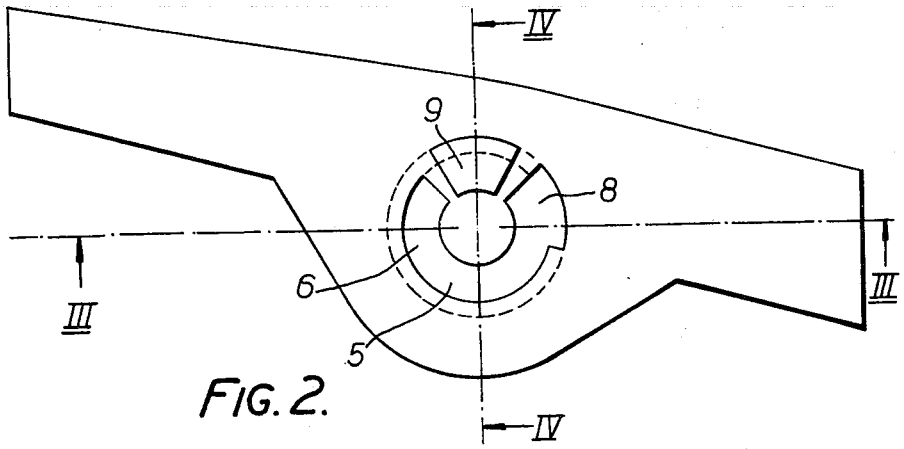
FIG. 2 is a fragmentary top plan view of the forcep member.
Figure 3:
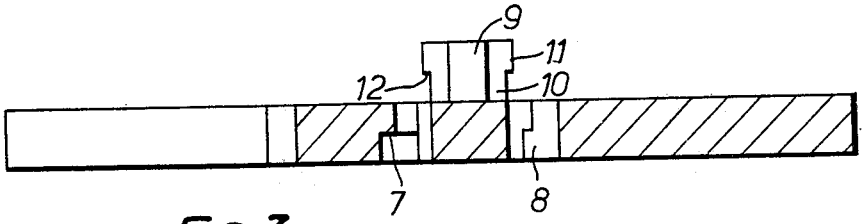
FIG. 3 is a section taken along the line III—III of FIG. 2.
Figure 4:
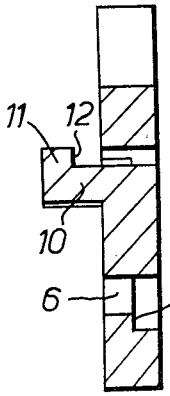
FIG. 4 is a section taken along the line IV—IV of FIG. 2.

The elongated forcep member 1 is moulded in one piece from synthetic plastics material and is formed with a serrated jaw 2 at its forward end and an operating handle part in the form of a ring 3 at the opposite end. Intermediate its ends, the member 1 has a pivot construction generally designated 4. The pivot construction, to be described in detail hereinafter, is provided for releasably connecting member 1 to an identical member to produce a pair of forceps of conventional form having a pair of cooperating jaws manipulated by actuating handles on the side of the fulcrum remote from the jaws.

The pivot construction 4 includes a circularly arcuate slot 5 which has a stepped outer diameter over a first major extent 6 thereof to form a circumferentially extending shouler 7, and an arcuate end portion 8 of uniform outer diameter corresponding to the larger outer diameter of slot portion 6. Projecting upwardly on the member and located between the arcuate ends of the slot 5 is a projection 9 of segmental cross-section and including a base 10 and an enlarged head 11 defining a shouler 12. The projection 9 has its radially innermost, part-cylindrical wall formed on a diameter corresponding to the inner diameter of slot 5, with the radially outer walls of base 10 and head 11 formed on the same diameters as the smaller and larger outer diameter of the slot portion 6, respectively. The arcuate extent of the projection is no greater than that of slot portion 8 and the height of the base 10 is at least as great as the depth of the smaller width slot part, which is located nearest the projection 9. This dimensioning ensures that the member can be combined with an identical member to produce a pair of forceps of conventional appearance. This is achieved by inverting the second member and placing it together with member 1 at a relative angular position such that projection 9 enters the enlarged slot end portion of the second member and the projection of the second member enters slot portion 8. The second member is then rotated in a counter-clockwise direction relative to the member 1 with the result that the shoulders 12 of the projections engage behind the shoulders 7 to retain the two members against separation.

The pivot constructions 4 are so arranged that during pivoting of the members in normal use of the forceps, the projections only travel along an end portion of the slots 5 remote from the enlarged portions 8, to prevent accidental disassembly. Of course if it is required to disconnect the members, for example to replace a member because it has become damaged, this is readily achieved simply by reversing the steps involved in the assembly.

I claim:

1. In a hand tool including a pair of identical separable members each comprising an elongated unitary body member having a jaw adjacent one end, a handle adjacent the other end, and pivot means intermediate said jaw and handle, said pivot means comprising a projection and a recess, said recess comprising a slot extending along the arc of a circle and including a main portion and a widened end portion, said projection comprising a base and an enlarged head and being positioned on said member on another part of said circle, said widened end portion of said slot being of a size to receive the enlarged head of a projection of a second member when said members are moved laterally towards each other in one relative angular position, said slot being of a size to receive the base portion of the projection of said second member and engage said enlarged head to retain said members against lateral separation when the two members are rotated from the said one angular position to a second normal working position in which said members are pivotally movable relative to each other.

2. A tool member according to claim 1, wherein said slot main portion has radially inner and outer side walls and a circumferentially extending shoulder on one of said side walls, and said projection has a shouler defined between said base and said head thereof for abutting engagement with said circumferentially extending shoulder of said second member to prevent separation of said members when they are in their working position.

3. A tool member according to claim 2 wherein the said one side wall of the slot is said radially outer wall.

4. A tool member according to claim 1 wherein said member is moulded from synthetic plastics material.

* * * * *